United States Patent [19]

Yamamoto

[11] 4,279,384

[45] Jul. 21, 1981

[54] STEAM GENERATION IN A DISHWASHER

[75] Inventor: Kunio Yamamoto, Daito, Japan

[73] Assignee: Sharp Kabushiki Kaisha, Osaka, Japan

[21] Appl. No.: 54,919

[22] Filed: Jul. 5, 1979

[30] Foreign Application Priority Data

Jul. 5, 1978 [JP] Japan ..... 53-93311[U]
Sep. 20, 1978 [JP] Japan ..... 53-129714[U]

[51] Int. Cl.[3] ..... A01G 27/00

[52] U.S. Cl. ..... 239/67; 134/30; 134/58 D; 134/102; 134/108; 134/25.2; 239/75; 239/136

[58] Field of Search ..... 239/135, 136, 139, 67, 239/68, 75; 134/25 A, 35, 58 D, 102, 105, 106, 108, 107

[56] References Cited

U.S. PATENT DOCUMENTS

| | | | |
|---|---|---|---|
| 1,142,083 | 6/1915 | Dodge | 134/102 |
| 1,916,806 | 7/1933 | Myrick | 134/102 |
| 2,621,666 | 12/1952 | Hiort Af Ornas | 134/107 X |
| 2,886,689 | 5/1959 | Garth | 239/75 |
| 3,971,913 | 7/1976 | Myklebust | 239/136 X |
| 4,132,883 | 1/1979 | Grime | 239/136 X |
| 4,135,531 | 1/1979 | Federighi | 134/102 X |

*Primary Examiner*—Richard A. Schacher
*Attorney, Agent, or Firm*—Birch, Stewart, Kolasch & Birch

[57] ABSTRACT

A dishwasher comprising a dishwashing tub, a liquid circulation pump, and an immersion heater disposed at a lower section of the dishwashing tub. The immersion heater is covered by a heater cover which includes a bottom free end and an upper free end. When the liquid circulation pump and the immersion heater are energized, warm liquid is circulated through the bottom free end of the heater cover. When only immersion heater is energized, the liquid disposed in the heater cover is heated up to generate the steam through the upper free end of the heater cover.

13 Claims, 4 Drawing Figures

STEAM GENERATION IN A DISHWASHER

BACKGROUND OF THE INVENTION

The present invention relates to a dishwasher and, more particularly, to a steam generating structure in a dishwasher.

A dishwasher including a steam washing step or a steam softening step is proposed in copending application, STEAM WASHING IN A DISHWASHER, Ser. No. 973,917, filed on Dec. 28, 1978 by Ichiro Oguri and Yoshihiro Koyama and assigned to the same assignee as the present application.

The present invention is to improve the steam generating means in a dishwasher such as disclosed in the above-mentioned application Ser. No. 973,917.

Accordingly, an object of the present invention is to improve a steam generating heater means in a dishwasher.

Another object of the present invention is to provide a heater means which functions to generate steam in a steam softening step and to warm up the water in a main washing step in a dishwasher.

Still another object of the present invention is to provide a novel heater cover for ensuring effective steam generation and also ensuring effective warming up of the water in a dishwasher.

Other objects and further scope of the applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, an immersion heater is disposed in a lower section of a dishwashing tub. A square shaped heater cover is provided to surround the immersion heater. The bottom free end of the heater cover functions to communicate the immersion heater with the dishwashing tub. The upper free end of the heater cover is covered by a filter.

A circulation pump is provided for selectively circulating the water within the dishwashing tub and emitting the water from a sprinkler. When the circulation pump and the immersion heater are energized, the water contained in the lower section of the dishwashing tub is forced to travel through the immersion heater and, therefore, the warm water is emitted from the sprinkler. When only the immersion heater is energized, the water disposed in the heater cover is heated up and, therefore, steam is generated through the filter which covers the upper free end of the heater cover.

In a preferred form, an overheat preventing sensor is disposed in the heater cover to ensure stable operation.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
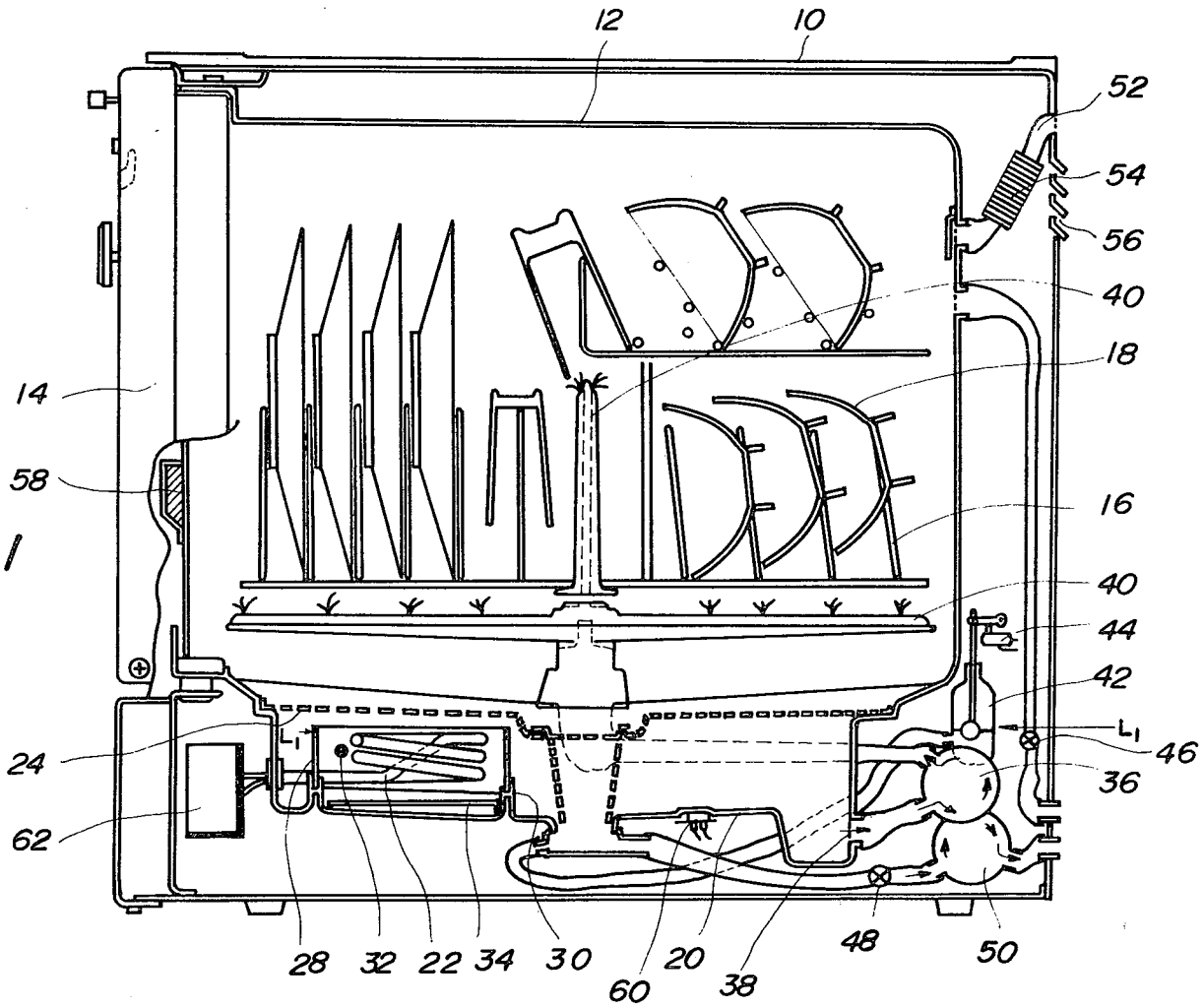
FIG. 1 is a sectional side view of an embodiment of a dishwasher of the present invention.

FIG. 1 shows an embodiment of a dishwasher of the present invention.

The dishwasher mainly comprises a housing 10, a dishwashing tub 12, and a front door 14 for giving access to a supporting rack 16 which supports tableware 18 in the dishwashing tub 12.

Figure 2:
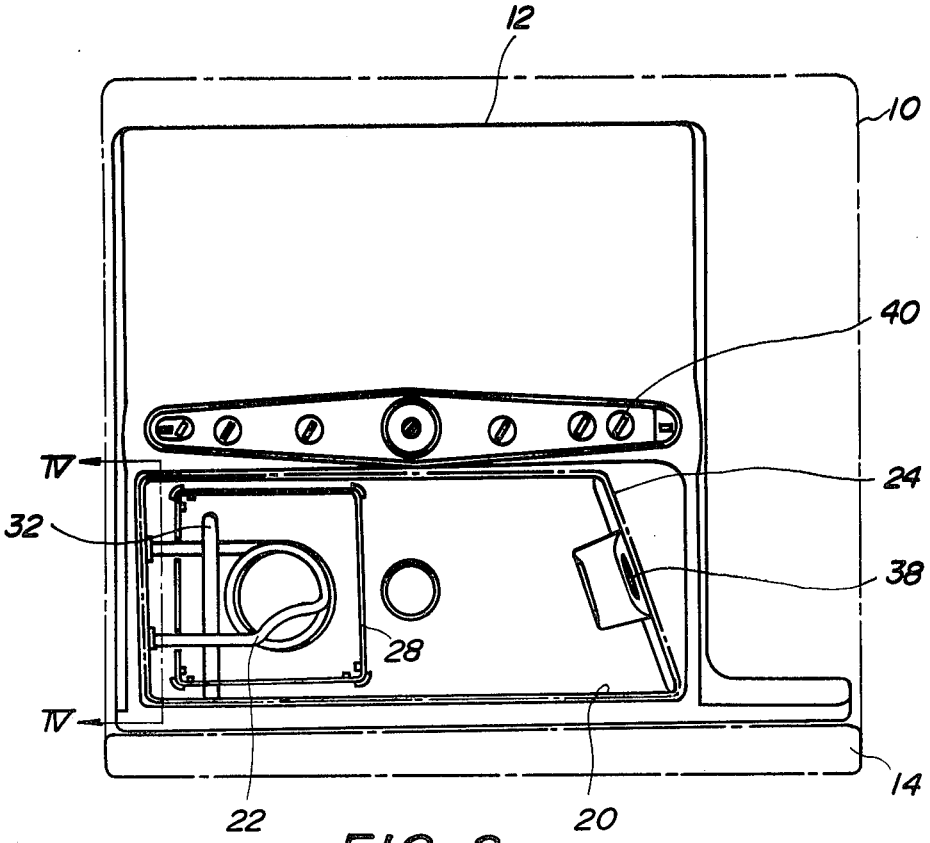
FIG. 2 is a sectional plan view of the dishwasher of FIG. 1.

The dishwashing tub 12 includes an indent section 20, where an immersion heater 22 is disposed for selectively generating steam and warming up water. FIG. 2 shows the indent section 20. Like elements corresponding to those of FIG. 1 are indicated by like numerals.

Figure 3:
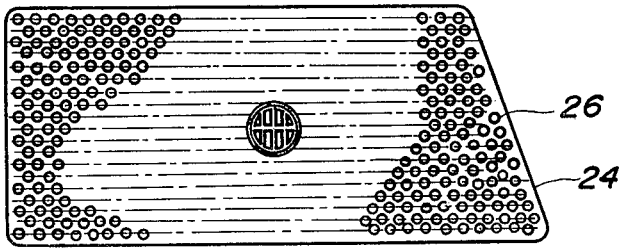
FIG. 3 is a plan view of a filter employed in the dishwasher of FIG. 1.

A filter 24 is provided to cover the indent section 20. FIG. 3 shows the filter 24. The filter 24 comprises a metal provided with openings 26 formed therein. The openings 26 are circles of 1.2 mm diameter and aligned in a 2 mm pitch (in the row direction) and a 3 mm pitch (in the column direction).

Figure 4:
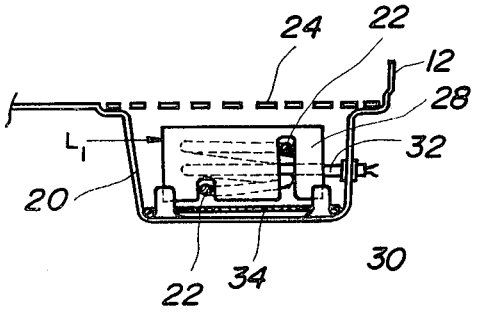
FIG. 4 is a sectional view taken along line IV—IV of FIG. 2.

A heater cover 28 is disposed around the immersion heater 22. FIG. 4 shows the heater cover 28 in great detail. Like elements corresponding to those of FIGS. 1 and 2 are indicated by like numerals.

The heater cover 28 comprises square shaped side walls. The bottom free end of the square shaped side walls functions to communicate the immersion heater 22 with the indent section 20 of the dishwashing tub 12. The upper free end of the square shaped side walls confronts the filter 24 with a distance formed therebetween. The square shaped side walls are supported by supporters 30 so that the water easily travels through the gap formed between the bottom free end of the square shaped side walls and the bottom wall of the dishwashing tub 12. An overheat preventing sensor 32 is disposed in the heater cover 28 to ensure stable operation. A heat screen plate 34 is disposed under the heater cover 28 for protecting the bottom wall of the dishwashing tub 12 from the heat energy generated by the immersion heater 22.

The dishwashing further comprises a circulation pump 36 which introduces the water from the dishwashing tub 12 through an inlet 38 and develops the water toward a sprinkler 40. The sprinkler 40 emits the water toward the tableware 18 supported by the supporting rack 16. The thus emitted water causes the rotation of the sprinkler 40 within the dishwashing tub 12. A float mechanism 42 is provided to detect the liquid level in the dishwashing tub 12. A microswitch 44 is associated with the float mechanism 42 to control the operation of a water supply valve 46.

Operation of the dishwasher of the present invention will be described with reference to specific washing steps.

First, the preliminary washing is performed after predetermined amount of water is introduced through the water supply valve 46. In the preliminary washing step, the circulation pump 36 is energized but the immersion heater 22 is not energized. The water is filled slightly above the filter 24. The switching level $L_1$ of the float mechanism 42 is lower than the height of the filter 24. However, the liquid level in the dishwashing tub 12 is held above the filter 24 due to the suction force created by the circulation pump 36. When the preliminary washing step is completed, the water is drained through a drain valve 48 and a drain pump 50. In the preliminary washing step, the water is about 4.5 l is supplied to the dishwashing tub 12. The circulation pump 36 has the ability to circulate the water at 80 l/min.

In the steam softening step and the steam drying step, the immersion heater 22 is energized but the circulation pump 36 is not energized. The heater is held at the level $L_1$, which is slightly lower than the upper free end of the heater cover 28 and slightly higher than the upper surface of the immersion heater 22. Typically, the water of about 2.5 l is introduced into the dishwashing tub 12 in the steam generation mode. Since the circulation pump 36 is not energized, the water contained in a section surrounded by the heater cover 28 is extremely heated up to generate the steam. The thus generated steam is applied through the openings 26 formed in the filter 24 to the tableware 18 supported by the supporting rack 16.

The steam filled in the dishwashing tub 12 is exhausted through an exhaustion pipe 52. A heat exchanger 54 is secured around the exhaustion pipe 52, and a louver 56 is provided in the housing 10 for cooling the outgoing steam.

In the main washing step, both of the inmersion heater 22 and the circulation pump 36 are energized. The water level is same as the preliminary washing operation. A cleaning agent is supplied from a cleaning agent supplier 58. The water heated up by the immersion heater 22 is developed from the gap formed below the heater cover 28 due to the suction force created by the circulation pump 36. That is, the warm liquid is emitted from the sprinkler 40. The water is maintained at a preferred temperature through the use of a thermostat 60 disposed at the bottom wall of the dishwashing tub 12. The entire water is warmed and the steam is not generated because of the circulation operation.

A power supply control unit 62 is disposed in the housing 10 for controlling operations of the water supply valve 46, the circulation pump 36, the immersion heater 22, the drain valve 48 and the drain pump 50. Of course, the power supply control unit 62 is responsive to output signals of the microswitch 44 and the thermostat 60.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A dishwasher comprising a dishwashing tub;

an immersion heater disposed at a lower section of said dishwashing tub for heating up water and generating steam;

a heater cover for substantially surrounding said immersion heater, said heater cover having a bottom-free end portion and an upper free end portion;

said bottom free end portion and the bottom wall of the dishwashing tub defining a gap therebetween for providing communication between said immersion heater and said dishwashing tub, external of said heater cover;

said upper free end portion of said heater cover providing communication between said immersion heater and the upper section of said dishwashing tub.

2. The dishwasher of claim 1, wherein said dishwashing tub comprises an indent section, said immersion heater and said heater cover being disposed in said indent section, and said dishwasher further comprising a filter for covering said indent section, said filter confronting said upper free end portion of said heater cover.

3. The dishwasher of claim 1 or 2, further comprising an overheat preventing sensor disposed in said heater cover for preventing the overheat of said immersion heater.

4. A dishwasher comprising a dishwashing tub;

an immersion heater disposed at a lower section of said dishwashing tub for heating up water and generating steam;

a heater cover for substantially surrounding said immersion heater said heater cover having a bottom free end portion and an upper free end portion; and a circulation pump operatively associated with said dishwashing tub for creating liquid flow through said immersion heater, wherein said immersion heater warms up the liquid disposed in said dishwashing tub when said circulation pump is energized, and generates steam through said heater cover when said circulation pump is not energized.

5. The dishwasher of claim 4, wherein said heater cover comprises surrounding side walls for surrounding said immersion heater, the bottom free end portion of said surrounding side walls functioning to communicate said immersion heater with said dishwashing tub external of said surrounding side walls, and the upper free end portion of said surrounding side walls functioning to communicate said immersion heater with the upper section of said dishwashing tub.

6. The dishwasher of claim 5, wherein said surrounding side walls extend apart from the bottom wall of said dishwashing tub to form a gap therebetween, said gap allowing the liquid flow from said immersion heater to said dishwashing tub external of said surrounding side walls when said circulation pump is energized.

7. The dishwasher of claim 6, further comprising a heat screen plate disposed on the bottom wall of said dishwashing tub and confronting said bottom free end of said surrounding side walls.

8. The dishwasher of claim 5, 6 or 7, wherein said dishwashing tub comprises an indent section where said immersion heater and said surrounding side walls are disposed.

9. The dishwasher of claim 8, further comprising a filter for covering said indent section, said filter also covering said upper free end of said surrounding side walls, wherein said steam is generated through said filter when said circulation pump is not energized.

10. The dishwasher of claim 8, further comprising a liquid level detector for maintaining the liquid level in the dishwashing tub slightly above the upper surface of said immersion heater and slightly lower than said upper free end of said surrounding side walls when said circulation pump is not energized.

11. The dishwasher of claim 4, 5, 6 or 7, further comprising a sprinkler disposed in said dishwashing tub and connected to said circulation pump for emitting the warm liquid supplied from said circulation pump.

12. The dishwasher of claim 11, further comprising a thermostat disposed at the lower section of said dishwashing tub for controlling the energization of said immersion heater so that the liquid disposed in the dishwashing tub is maintained at a preferred temperature when said circulation pump is energized.

13. The dishwasher of claim 11, further comprising an overheat preventing sensor disposed in said heater cover for preventing the overheat of said immersion heater.

* * * * *